US009732558B2

(12) United States Patent
Ayala

(10) Patent No.: US 9,732,558 B2
(45) Date of Patent: Aug. 15, 2017

(54) LADDER TOOL HOLDER

(71) Applicant: Lawrence Ayala, Prescott Valley, AZ (US)

(72) Inventor: Lawrence Ayala, Prescott Valley, AZ (US)

( * ) Notice: Subject to any disclaimer, the term of this patent is extended or adjusted under 35 U.S.C. 154(b) by 0 days.

(21) Appl. No.: 14/512,424

(22) Filed: Oct. 11, 2014

(65) Prior Publication Data

US 2016/0102496 A1 Apr. 14, 2016

(51) Int. Cl.
*E06C 7/14* (2006.01)
*E06C 7/00* (2006.01)

(52) U.S. Cl.
CPC ..... *E06C 7/143* (2013.01); *E06C 7/14* (2013.01); *E06C 7/00* (2013.01)

(58) Field of Classification Search
CPC ... E06C 7/143; E06C 7/00; E06C 7/14; E06C 7/146
USPC ..... 248/210, 211, 238, 115, 116, 141, 142, 248/206, 194, 129
See application file for complete search history.

(56) References Cited

U.S. PATENT DOCUMENTS

| | | | | | |
|---|---|---|---|---|---|
| 2,698,450 | A | * | 1/1955 | Mack | 15/257.06 |
| 3,559,939 | A | * | 2/1971 | Luna | 248/210 |
| 3,590,416 | A | * | 7/1971 | Henningsen | 15/257.06 |
| 3,807,677 | A | * | 4/1974 | Munnoch et al. | 248/316.1 |
| 4,186,903 | A | * | 2/1980 | Fazakerley | 248/210 |
| 4,405,051 | A | * | 9/1983 | Thalenfeld | 211/57.1 |
| 4,445,659 | A | * | 5/1984 | LaChance | 248/210 |
| 4,660,794 | A | | 4/1987 | Given | |
| 4,756,504 | A | * | 7/1988 | Chamberlain | 248/552 |
| 4,824,060 | A | * | 4/1989 | Korda | 248/210 |
| 5,031,723 | A | | 7/1991 | Hooten | |
| 5,035,299 | A | | 7/1991 | Eisenberg | |
| 5,135,193 | A | | 8/1992 | Parris | |
| 5,276,943 | A | * | 1/1994 | Ludy | 16/445 |
| 5,293,957 | A | | 3/1994 | Lunden, Jr. | |
| 5,316,251 | A | | 5/1994 | McGraw | |
| D393,413 | S | * | 4/1998 | Brown | D8/370 |
| 5,845,742 | A | * | 12/1998 | Tade et al. | 182/129 |
| 5,934,632 | A | * | 8/1999 | Weaver | 248/210 |
| 5,950,762 | A | * | 9/1999 | George | 182/129 |

(Continued)

OTHER PUBLICATIONS

Extension Ladder Bucket Holder, http://www.todayshomeowner.com/video/extension-ladder-bucket-holder/.

(Continued)

*Primary Examiner* — Nkeisha Smith
(74) *Attorney, Agent, or Firm* — Inspired Idea Solutions Law Firm; Wayne Carroll

(57) ABSTRACT

A ladder tool is disclosed and is useful for supporting tools safely, including tools with hoses or cords attached to them. Disclosed embodiments include a support for inserting into a hollow ladder rung, and a tool holder attached to the support structure. The tool holder has an incomplete polygonal shape and provides an opening for the hose or cord to enter and exit the tool holder, so that the operation of passing the hose or cord through the opening can be performed with one hand. The disclosure also includes a support extension that passes clear through the hollow rung of a ladder has a safety tab that rotates down by gravity to prevent the ladder tool from accidently being pulled out or displaced from the ladder rung.

13 Claims, 7 Drawing Sheets

(56) References Cited

U.S. PATENT DOCUMENTS

| | | | | |
|---|---|---|---|---|
| 5,960,905 | A * | 10/1999 | Gardner | 182/129 |
| 5,971,103 | A * | 10/1999 | Mulvaney | 182/129 |
| 6,009,976 | A * | 1/2000 | Gorney et al. | 182/129 |
| 6,076,636 | A * | 6/2000 | Tietge | 182/129 |
| 6,131,866 | A | 10/2000 | Kesinger | |
| 6,254,045 | B1 * | 7/2001 | Oatsvall | 248/210 |
| 6,269,907 | B1 * | 8/2001 | Gillespie | 182/129 |
| 6,352,135 | B1 * | 3/2002 | Jones | 182/129 |
| 6,382,353 | B2 * | 5/2002 | Laug | 182/107 |
| 6,766,990 | B1 * | 7/2004 | Hileman et al. | 248/210 |
| 6,824,115 | B1 * | 11/2004 | Batson | 248/238 |
| 7,059,448 | B2 | 6/2006 | Beechler | |
| 7,309,088 | B2 | 12/2007 | Fiore et al. | |
| 7,438,267 | B2 * | 10/2008 | Bardill et al. | 248/210 |
| 7,607,623 | B2 * | 10/2009 | Wesolowski | 248/210 |
| 7,905,458 | B2 * | 3/2011 | Hohensee | 248/210 |
| 8,033,362 | B1 | 10/2011 | Cull | |
| 8,162,275 | B2 * | 4/2012 | Reusser | 248/210 |
| 2006/0131106 | A1 * | 6/2006 | Adams | 182/129 |
| 2007/0063120 | A1 * | 3/2007 | Robbins | 248/304 |
| 2007/0272813 | A1 * | 11/2007 | Monteleone et al. | 248/303 |
| 2007/0272814 | A1 * | 11/2007 | Bardill et al. | 248/305 |
| 2008/0061201 | A1 * | 3/2008 | Sasser | 248/210 |
| 2011/0253759 | A1 * | 10/2011 | Scalese et al. | 224/660 |
| 2013/0140423 | A1 * | 6/2013 | Taylor | 248/544 |
| 2013/0192924 | A1 | 8/2013 | Paun | |
| 2013/0256481 | A1 * | 10/2013 | Saucier | 248/210 |
| 2013/0264443 | A1 * | 10/2013 | Armas | 248/219.4 |
| 2014/0263897 | A1 * | 9/2014 | Saucier et al. | 248/210 |
| 2015/0108302 | A1 * | 4/2015 | Kahn | 248/210 |
| 2015/0115111 | A1 * | 4/2015 | Smith | 248/77 |

OTHER PUBLICATIONS

The Hangman: an invention to secure tools to your ladder by Kayenta Saucier—Kickstarter, https://www.kickstarter.com/projects/thehangman/the-hangman-an-invention-to-secure-tools-to-your-l.

* cited by examiner

LADDER TOOL HOLDER

BACKGROUND

1. Technical Field

This disclosure relates to ladders with an open rung, and more specifically tools designed to work in ladders with an open rung.

2. Background

Workers who use extension ladders often have multiple pieces of equipment or tools that they need to use when they are on a ladder. For example a painter may use a paint sprayer with a hose line, and have a paint roller that are used in conjunction. Other workers use equipment with electrical cords such as a drill, and have other tools that are needed at the same time.

Workers will often bring multiple tools up on a ladder, and store some of the tools on the rungs of the ladder until needed. For example, a painter will bring a paint sprayer and a roller up on a ladder, and place the roller resting against a ladder rung while spraying, and then will place the paint sprayer resting on a ladder rung while using the roller to further spread the paint.

The past methods present a hazard as a cord or hose can trip the worker when it hangs onto the ladder rungs. When a tool with a cord or hose is stored on one of the ladder rungs, the cord or hose will hang down along the rungs of the ladder where the worker is standing. The hose or cord can interfere with the feet of the worker and cause a hazardous situation. The tool can also be damaged if the worker steps on the hose or cord, or accidently causes the equipment to fall.

Tools that do not have a cord or hose can also be hazardous when used on an extension ladder, because the worker needs to hold the tool or balance the tool on the ladder so that it will not fall when it is being used. If the tool is dropped the tool can break, or someone working below the ladder can become injured.

BRIEF SUMMARY

A device is disclosed including a support for inserting into a hollow ladder rung, where the support fits inside the hollow ladder rung. The disclosed device also includes a tool holder coupled to the support. The tool holder includes a first portion substantially parallel to the support and coupled to the support. The tool holder also includes a second portion connected to the first portion, the second portion having a shape of an incomplete polygon. The tool holder further comprises a third portion connected to the second portion, wherein the third portion is parallel to the first portion, and extends within proximity of the first portion.

The hollow ladder rung may have a cross section with a shape, and the support may have a portion that is approximately the same shape as the cross section of the hollow ladder rung. The tool holder may have a shape with an opening between the first portion and the third portion. The tool holder may be a metal rod formed to have an opening between approximately three-eighths of an inch to approximately three inches, between the first portion and the third portion.

The second portion may have a first side, a second side and a third side. The first side is connected to the first portion, and the second side is connected to the first side, and the third side is connected to the second side and to the third portion. The first side may be substantially parallel with the third side, and the first side may have a length, and the third side may have a length. The length of the first side may be shorter than the length of the third side.

The second portion may have a first perpendicular side that is substantially perpendicular to the first portion, and that is connected to the first portion, and a second perpendicular side that is substantially perpendicular to the first portion and that is connected to the third portion.

The first perpendicular side may have a length, and the second perpendicular side may have a length, and the length of the second perpendicular side may be longer than the length of the first perpendicular side.

The hollow ladder rung may have a first side with a first opening, and a second side with a second opening, and the hollow ladder rung may have a length between the first opening and the second opening. The support may have a length that is longer than the length of the hollow ladder rung.

In another embodiment a device is disclosed including a support structure having a first section to be inserted into a first ladder rung with a first size wherein the first section is shaped approximately the same shape as the first ladder rung, the support structure having a second section to be inserted into a second ladder rung with a second size that is larger than the first size of the first ladder rung. The first section is connected to the second section along a longitudinal axis. A tool holder may be attached to the second section of the support structure along the longitudinal axis.

The second section may be tapered having a smaller circumference at a first end and a large circumference at a second end. The first section may have a generally square cross-section. The second section may have a generally "D" shaped cross-section.

In another disclosed embodiment the tool holder includes a first portion substantially parallel to the support structure and coupled to the support structure; a second portion connected to the first portion, the second portion having a the shape of an incomplete polygon. A second portion may be connected to the first portion, and the second portion may have a shape of an incomplete polygon having a beginning and an end. The end of the incomplete polygon may extend within proximity of a portion of the incomplete polygon to create an opening. The end of the incomplete polygon may be a distance from the portion of the incomplete polygon within a range of about three-eighths of an inch to approximately three inches.

In another embodiment the distance from the end of the incomplete polygon to the portion of the incomplete polygon is about three-quarters of an inch. In another embodiment the distance from the end of the incomplete polygon to the portion of the incomplete polygon is about one inch.

Another embodiment is disclosed with a device including a support configured to securely fit into a hollow rung of a ladder having a generally flat top. The support may align a rotation of the support to the flat top of the rung of the ladder, and may prevent rotation of the support when inserted into the hollow rung of the ladder. A tool holder may be connected to the support, with the tool holder fixed rotationally to the support. The tool holder may have the shape of an incomplete polygon generally within a flat plane that is substantially parallel to the generally flat top of the hollow rung. The incomplete polygon may form a shape with a width and length. The incomplete polygon may have an end that forms an opening, with the opening having a distance defined by the narrowest point that would restrict an object passing through the opening into the incomplete polygon. The opening may be narrower than the width of the incomplete polygon, and narrower than the length of the incomplete polygon. The tool holder may be configured to allow a hose to pass through the opening.

DETAILED DESCRIPTION

Figure 2:
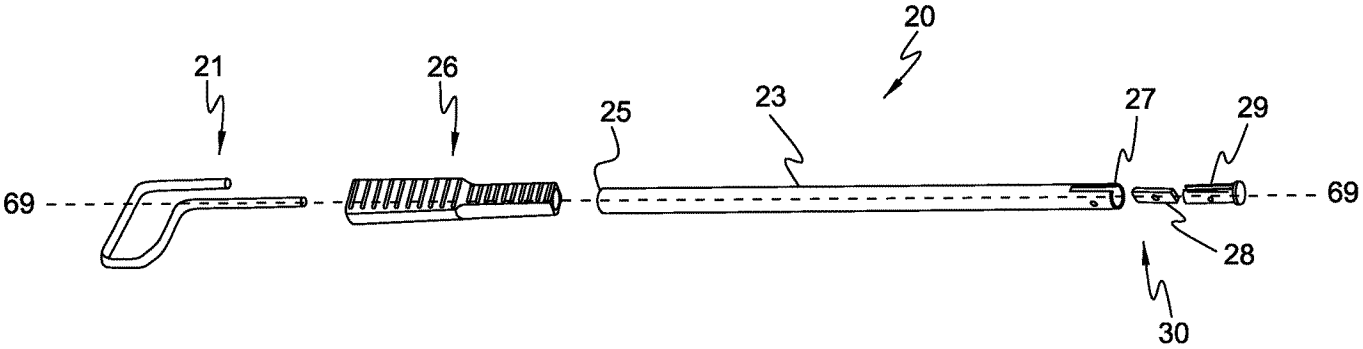
FIG. 2 is an exploded view of an embodiment of a ladder tool.
Figure 1:
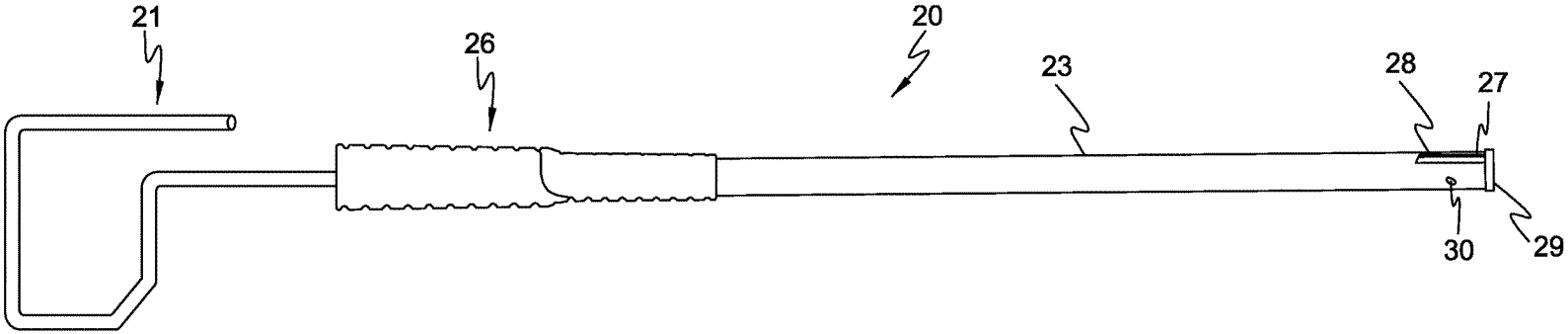
FIG. 1 is a perspective view of an embodiment of a ladder tool.

An example embodiment of a device 20 is shown in FIGS. 1 and 2. The example device is a ladder tool 20 with support 26 designed to fit inside the rung of a hollow rung ladder. At one end of the support a tool holder 21 is connected to the support 26. The support has a longitudinal axis 69, and the tool holder 21 is connected to the support 26 along the longitudinal axis 69. At the other end of the support 26 a support extension 23 is also connected along the longitudinal axis 69. The support extension 23 has a first end 25 connected to the support 26, and a second end 27. The second end 27 has a slot cut to receive a safety tab 28. The safety tab 28 is held in place by a fastener such as a rivet 30. An end cap 29 is also connected to the second end 27 with the fastener 30.

In the illustrated example the ladder tool 20 may be placed into the rung of a ladder such as an extension ladder or an a-frame ladder with open rungs. The support 26 fits tightly into the hollow rung, and the support extension 23 extends into the hollow ladder rung and out the other side of the ladder. The second end 27 of the support extension 23 comes out the other side of the ladder and the safety tab 28 rotates because the rivet is off center in the safety tab 28 and the weight of the safety tab 28 on the one side of the rivet 30 is heavier and naturally rotates down due to gravity.

In one embodiment the support extension 23 is a round metal rod or steel pipe. In other embodiments the support extension 23 may be made from other metal material, or from non-metallic materials. The support extension 23 is shown in the illustrated embodiment as round. In other embodiments the support extension 23 may be other shapes including square, triangular, hexagonal, or other shapes.

Figure 4:
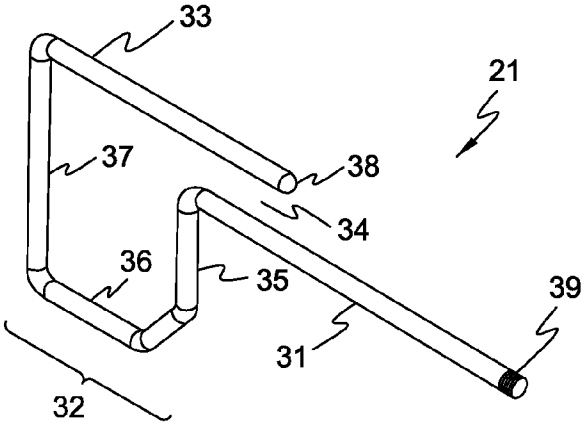
FIG. 4 is a perspective view of an embodiment of a portion of a ladder tool.
Figure 5:
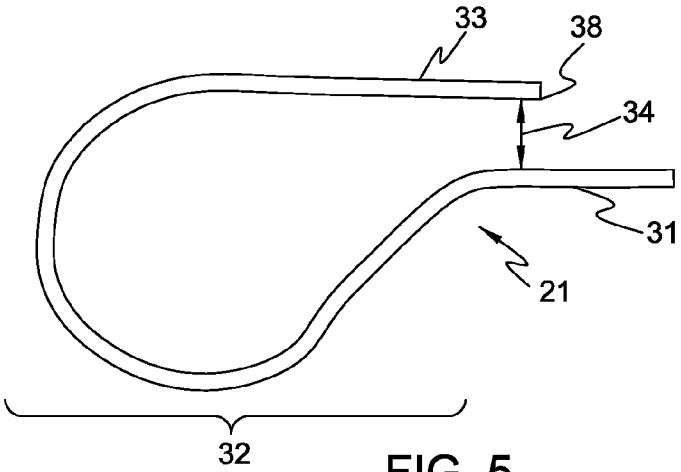
FIG. 5 is a top view of another embodiment of a portion of a ladder tool.
Figure 3:
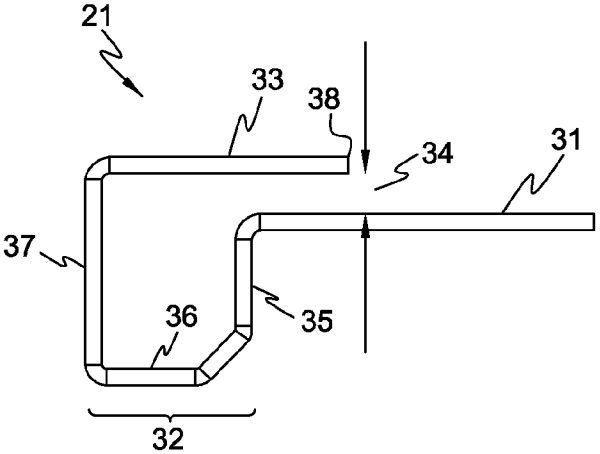
FIG. 3 is a top view of an embodiment of a portion of a ladder tool.

The tool holder 21 can support a tool such as a paint sprayer and allow a worker to safely navigate a ladder or use other tools without holding or balancing the paint sprayer. FIGS. 3-5 show variations of a tool holder. The tool holder in these embodiments has a first portion 31 that connects to the support 26 and is along the longitudinal axis 69 shown in FIG. 1.

In the example embodiment of FIGS. 3 and 4 the tool holder 21 has a second portion 32 with three main sides, a first side 35 connected to the first portion 31 and substantially perpendicular to the first portion 31. In this example the second side 36 has an angled portion, angled on about a forty-five degree angle between the first side 35 and a portion of the second side 36. The first side 35 is substantially perpendicular to a portion of the second side 36. A third side 37 is shown as substantially parallel to the first side 35, and connected to the second side 36.

The example embodiment of FIGS. 3 and 4 also shows a third portion 33 of the tool holder 21 that is substantially perpendicular to the third side 37 of the second portion 32. The third portion 33 is substantially parallel to the first portion 31 and there is a distance that creates an opening 34 (shown between the arrows in the illustration) between the end 38 of the third portion 33 and the first portion 31.

In an example embodiment the distance of the opening 34 is approximately three-quarters of an inch to allow standard size hoses to enter and exit easily, such as the standard size garden hoses, and standard size pressurized paint hoses. In other embodiments the opening 34 is smaller, for example approximately three-eighths of an inch for smaller hoses and for electrical cords. In other embodiments the opening may be of other sizes varying from about three-eighths of an inch to about three inches.

The tool holder 21 may be attached to the support 26 in many different ways. FIG. 4 shows an example embodiment with a threaded end 39 that may be used to secure the tool holder 21 to a threaded piece in the support 26 or a threaded piece in the support extension 23. A locking nut may be used to secure the threaded end 39, and the tool holder 21 in a preferred rotational position. In other embodiments the tool holder 21 may be secured to the support extension 23 by welding, and the support 26 may be formed or assembled around the support extension 23. Other embodiments may use adhesives, or structures to secure the tool holder 21. For example, the end of the tool holder may have an angle that is designed to be inside the interior of the support that will prevent the tool holder 21 from rotating relative to the support 26.

FIG. 5 shows another embodiment of a tool holder 21. In this embodiment the second portion 32 is a polygon with a rounded shape to form a place to support a tool and an opening 34 where a cord or hose can enter and exit.

In an example embodiment when the ladder tool 20 is inserted into a ladder where the top of the ladder rungs are generally horizontal, the tool holder 21, is also generally horizontal. The support 26 in this embodiment has one or more generally flat top portions that aligns the ladder tool 20 to the top of a ladder rung and prevents the ladder tool 20 from rotating. In this embodiment the tool holder 21 is generally flat and within a horizontal plane, which is aligned to be substantially parallel to the top of the ladder rung. The tool holder 21 forms an incomplete polygon within the horizontal plane, having an end 38 of the incomplete polygon. The end 38 of the incomplete polygon is close to another part of the tool holder 21. The shortest distance between two parts of the incomplete polygon near the end 38 define the width of an opening 34.

The incomplete polygon has a length and a width. The width of the opening 34 in this example embodiment is narrower than the length and width of the incomplete polygon. For example, the width of the opening may be about 0.75 inches, and the width of the polygon shown in FIG. 3 may be about 2.3 inches, and the length, along the third side 37 may be about 3.5 inches. In other embodiments the shape of the incomplete polygon may have a generally round portion. For example FIG. 5 shows a tool holder 21 with a generally round portion that may have a dimension defined in part by a circle with a diameter. In the example embodiment of FIG. 5 the opening 34 has a distance that is less than the distance of the diameter of the circle defining a portion of the tool holder. The diameter of the circle in this embodiment is the length of the incomplete polygon.

Figures 6A, 6B, 6C, 6D, 6E, 6F, 6G:
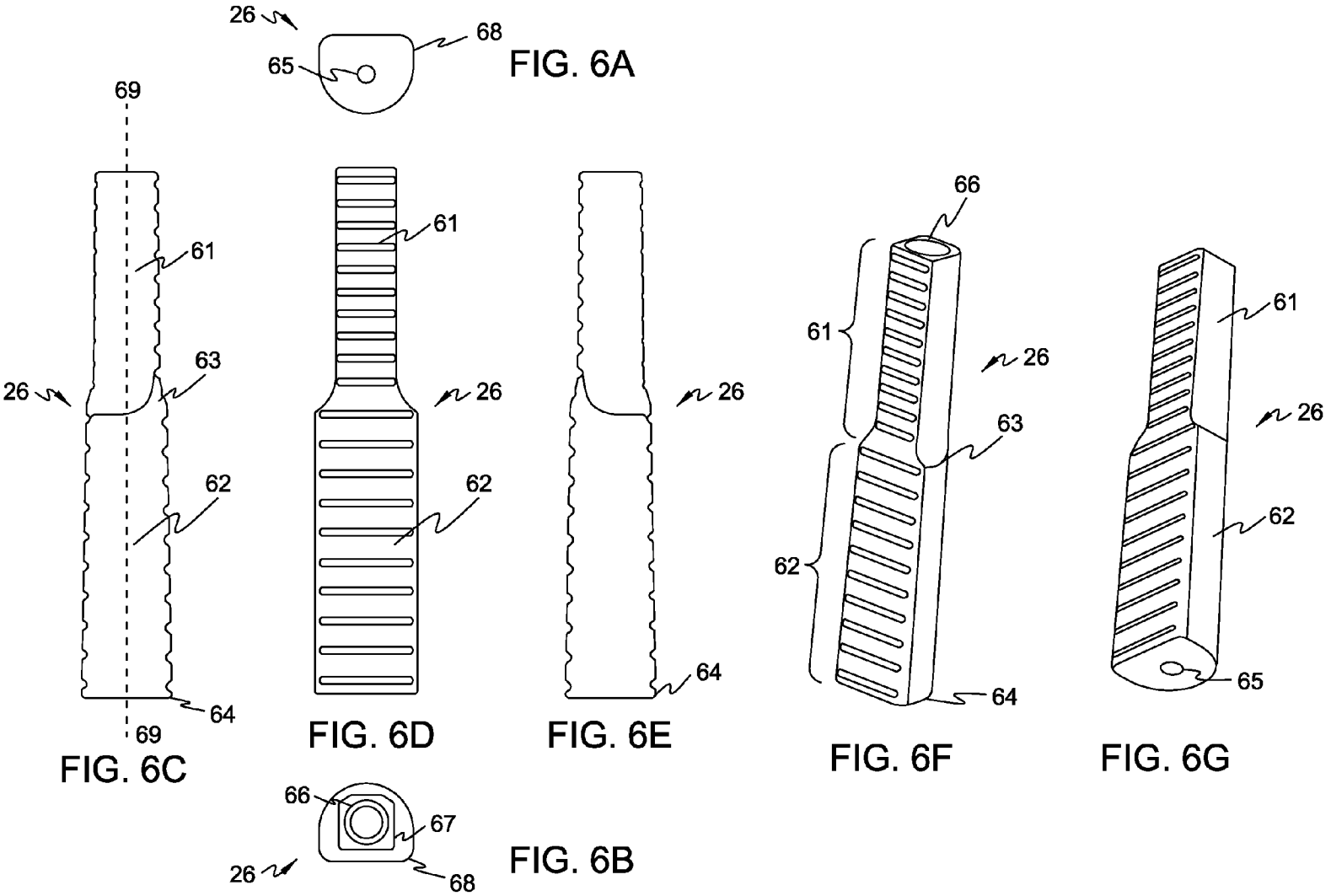
FIG. 6*a-g* are views of an embodiment of a support.

FIGS. 6*a*-6*g* show views of an embodiment of a support 26 used with the ladder tool 20. The illustrated support 26 has a first section 61 that is generally square, and a second section 62 that is generally a d-shape. FIG. 6*a* is a view of the support 26 from the second end along the longitudinal axis 69. FIG. 6*a* shows a tool holder opening 65 which in this embodiment is along the longitudinal axis 69.

Figure 8:
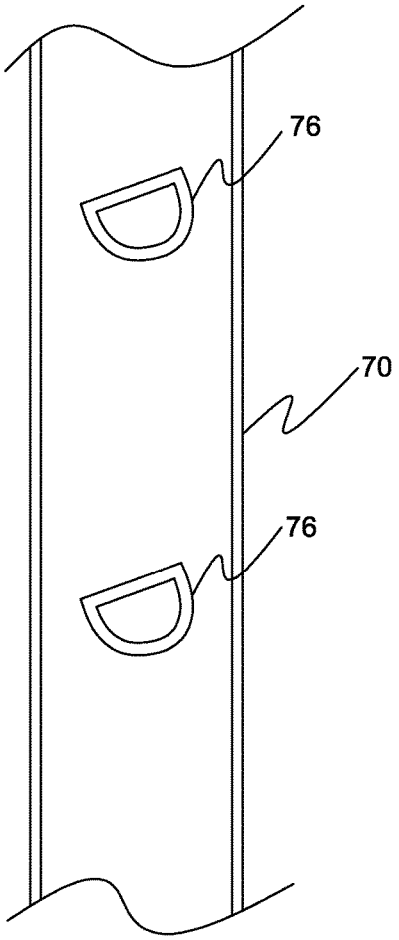
FIG. 8 is a side view of a ladder for use with an embodiment of the ladder tool.

FIG. 6*a* shows that a cross section of the second section 62 generally has a d-shape and corresponds with the shape of the inside of the rung of many extension ladders. An example extension ladder 70 is illustrated in FIG. 8 with a side view showing the generally D-shape of the rung 76 of the ladder 70, with the flat part of the D-shape at an angle so that when the ladder is placed at an appropriate angle to be safely used, the ladder flat part of the D-shape is close to level.

Figure 9:
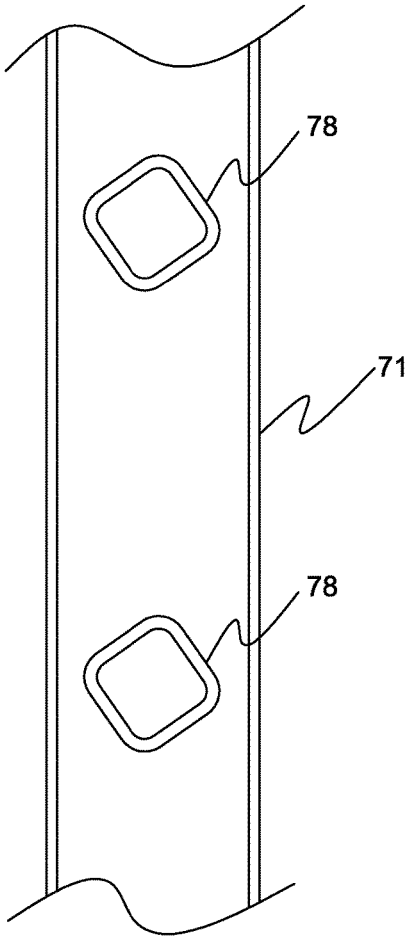
FIG. 9 is a side view of another ladder for use with an embodiment of the ladder tool.
Figure 13:
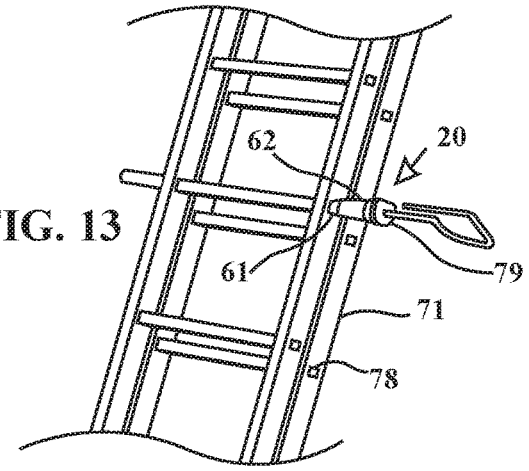
FIG. 13 shows and example of a ladder with hollow rungs.

FIG. 6*b* shows a view along the longitudinal axis 69 from the end of the first section 61. The generally square cross section 67 of the first section 61 is illustrated, as well as the generally D-shape cross section 68 of the second section 62. The generally square cross section may fit snugly into a ladder with a square cross section, such as a ladder 71 shown in FIG. 9. In the example of FIG. 9 the ladder shown is not an extension ladder, but is a foldable ladder or an articulated ladder that can serve as an a-frame ladder or as a straight ladder. The hollow rungs 78 are generally square and have a generally square cross section. FIG. 13 shows an example of a ladder 71 with hollow rungs 78 that have a square cross section. FIG. 13 shows that the device 20 may be inserted into the hollow rung 78 with the first section 61 designed to fit snugly inside the rung. At least a portion of the first section may be inserted into the hollow rung 78, while the second section 62 and the third section 79 may be outside the hollow rung 78.

In the example embodiment illustrated in FIG. 6, the support 26 has a smaller circumference on the first section 61, and the first section may have a slight taper. The support 26 may have a taper between the first section 61 and the second section 62, and the second section may have a taper so that the first end 63 of the second section 62 has a smaller circumference than the second end 64 of the second section 62.

The support 26 may also have a support extension opening 66 that is configured to receive and hold the support extension 23. In other embodiments the ladder tool does not have a support extension and the device is held in place only with the support. The support 26 may have grooves that improve grip as a worker is holding the support, as well as improving the grip of the support when placed inside the hollow rung of a ladder.

Figure 7:
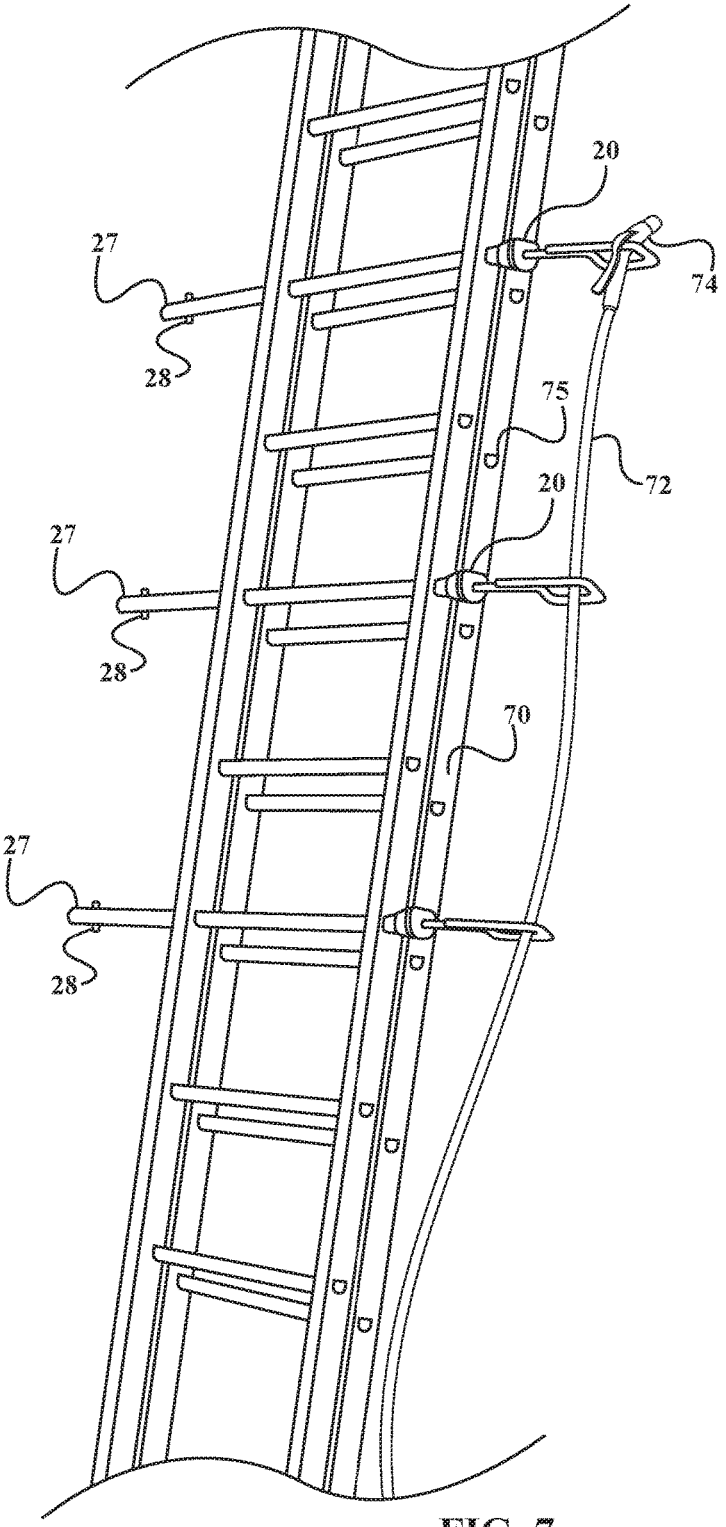
FIG. 7 is a perspective view of a ladder and an embodiment of a ladder tool in use with a hose.

FIG. 7 shows an example embodiment of a ladder tool 20 in use on an extension ladder 70 with hollow rungs. A first ladder tool 20 is placed in a hollow rung near the top of the ladder 70 and supports a tool 74, in this case a hose sprayer that might be used to clean out the gutter of a house. A hose 72 is connected to the tool 74. The hose also passes through a second ladder tool 20 placed in a lower hollow rung of the ladder 70. The ladder tool 20 is placed in the first side of the ladder that has a first opening 75. The second end 27 of the support extension 23 is shown on the second side of the ladder coming out of a second opening of a rung of the ladder. The safety tab 28 is also shown.

The ladder tool 20 may be used by placing a first ladder tool 20 near the bottom of the ladder 70 to support the hose 72 away from the ladder 70. The hose may be moved through the opening 34 (shown in FIGS. 3-5) while holding the tool 74. In the example embodiment the action of moving the hose 72 through the opening 34 while holding tool 74 may be done with one hand and quickly. A second ladder tool 20 may be placed in the ladder 70 near the top of the ladder 70. The hose can then easily pass through the lower ladder tool 20 as a worker climbs the ladder and with one hand again pass the hose through the opening 34 to store the tool 74 while other operations are performed. When the tool 74 is needed the hose 72 can pass out through the opening 34 with a one handed operation.

The ladder tool 20 may be removed from the ladder 70 by rotating the safety tab 28 to be parallel with the support extension 23, and pushing the second end 27 of the support extension 23 into the ladder rung. The ladder tool 20 may then be removed from the first side of the ladder 70 through the first opening 75.

The above embodiments are illustrated and discussed as examples. Variations may be made in the shape, materials, function and operation of the above embodiments and remain within the invention as claimed. For example, the support 26 is shown with a flat side on top. In other embodiments the support structure may be round without a flat side and may fit into the hollow rung of a ladder.

Figure 10:
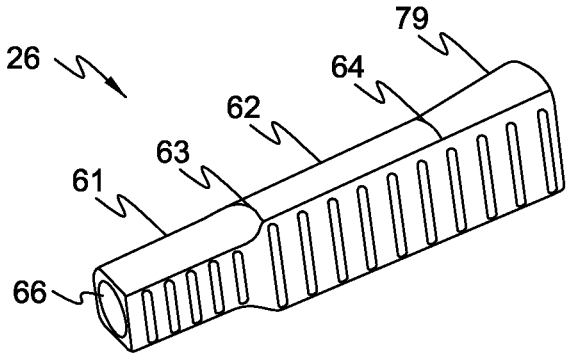
FIG. 10 is a perspective view of an embodiment of a support portion of a ladder tool.
Figure 14:
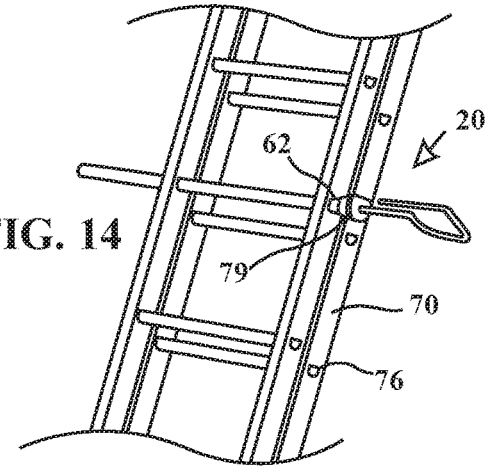
FIG. 14 shows an example embodiment with the device inserted into a ladder that has a smaller D-shaped rungs.
Figure 15:
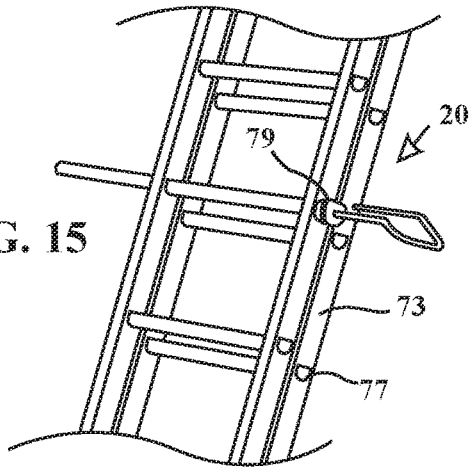
FIG. 15 shows an exmple embodiment with the device inserted into a tall ladder with large rungs.

FIG. 10 shows an example embodiment of a support with a first section 61 that has a generally square shape which is designed to fit snugly into a ladder rung that is generally square. A second section 62 is generally D-shaped to fit within ladder rung with a D-shaped rung. The second section 62 in this embodiment is tapered to allow use with multiple sizes of D-Shaped ladder rungs. The second section 62 is tapered at a first rate or a first angle between a first end 63 and a second end 64. A third section 79 is shown in the illustration that is tapered at a second rate with a greater angle than the first rate. The second section 62 may allow the support 26 to fit securely into ladder rungs with smaller D-shaped rungs, while the third section 79 may allow the support 26 to fit securely into larger size D-shaped rungs 77. FIG. 14 shows an example embodiment with the device 20 inserted into a ladder 70 that has smaller D-shaped rungs 76. The first section 61 may be inserted entirely into the rung 76, and the second section 62 may be at least partially inserted into the rung 76 to achieve a secure fit with rung 76, while the third section 79 may be outside of the rung 76. FIG. 15 shows an example embodiment with the device 20 inserted into a tall ladder 73 with large rungs 77. The device may be used with the tall ladder 73 with the first section 61, and the second section 62 entirely inside the larger size D-shaped rung 77, and with at least a portion of the third section 79 inserted into the larger size D-shaped rung 77 to achieve a secure fit with the larger size D-shape rung 77.

Figure 11:
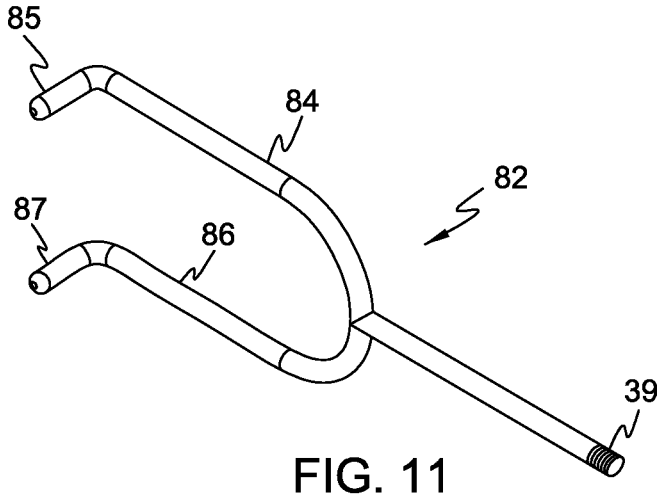
FIG. 11 is a perspective view of an embodiment of a portion of a ladder tool.

FIG. 11 shows another embodiment of a tool holder as a two-prong tool holder 82. The two-prong tool holder 82 in this embodiment has a first arm 84 and a second arm 86. The first arm 84 has a first end 85, and the second arm 86 has a second end 87. The first arm 84 and second arm 86 may be assembled with the support 26 and secured in a position so that the first arm 84 and the second arm 86 are generally horizontal when the ladder tool 20 is installed into the rung of a ladder. The first end 85 and the second end 87 may be generally vertical when the ladder tool 20 is installed. The two-prong tool holder 82 is shown with a threaded end 39 in the example illustrated embodiment, and may be secured into a position chosen by a worker for example the rotational position may be secured using a locking nut.

Figure 12:
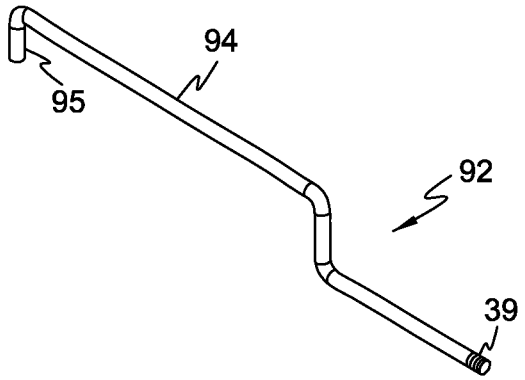
FIG. 12 is a perspective view of an embodiment of a portion of a ladder tool.

FIG. 12 shows another embodiment of a tool holder which also has a threaded end 39 and may similarly be installed by a worker into a rotational position. A tool holder with a threaded end 39 may also be removed by a worker and replaced with a different style tool holder. For example, the tool holder shown in FIG. 4 may be useful for a worker when they are using a tool with a hose, while the tool holder in FIG. 11 may be useful when a worker is using tape and needs to store rolls of tape.

In the embodiment shown in FIG. 12 the tool holder is a single-prong tool holder 92, with an arm extension 94 and an extension end 95. As with the example shown in FIG. 11, the single-prong tool holder 92 may be installed so that the extension end 95 is generally vertical when the ladder tool 20 is installed. The single-prong tool holder 92 may be useful for holding bags with tools and supplies, rolls of tape, tools with a hook or opening installed on the tool, as well as other tools and supplies which are used while a worker is on a ladder.

The term generally square as applied to ladder rungs includes structures shapes with four equal sides, as well as shapes with two sides long than the other sides. Generally square includes rectangular, and shapes with rounded corners.

While the principles of the invention have been made clear in illustrative embodiments, there will be immediately obvious to those skilled in the art many modifications of structure, arrangement, proportions, and methods, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What is claimed is:

1. A device comprising:

a support, including a first section and a second section, for inserting into a hollow ladder rung, wherein the first section includes a part of the support that only tightly fits inside a generally square shaped hollow ladder rung; and the second section includes a part of the support that only tightly fits inside a generally D-shaped hollow ladder rung, wherein the second section is tapered at a first rate or a first angle between a first end and a second end of the second section, and wherein the support includes a third section adjacent to the second section, wherein the third section is tapered at a second rate or a second angle with a greater angle than the first rate or the first angle; and further comprising a tool holder coupled to either the second section or the third section of the support, the tool holder comprising:

a first portion extending along a longitudinal axis of the support and coupled to the support, and a second portion extending from the first portion, the second portion having a shape with an opening.

2. The device according to claim 1 wherein the second portion has a first side, a second side extending from the first side, and a third side extending from the second side, wherein the first side extends from the first portion, and wherein the tool holder includes a third portion extending from the third side of the second portion, and wherein the first side is substantially parallel with the third side, and wherein the first side has a length, and the third side has a length, and wherein the length of the first side is shorter than the length of the third side.

3. The device according to claim 1 wherein the second portion has a first perpendicular side that is substantially perpendicular to the first portion, and that extends from the first portion, and a second perpendicular side that is substantially perpendicular to the first portion and wherein the tool holder includes a third portion extending from the second perpendicular side.

4. The device according to claim 3 wherein the first perpendicular side has a length, and the second perpendicular side has a length, and wherein the length of the second perpendicular side is longer than the length of the first perpendicular side.

5. The device according to claim 1 wherein the hollow ladder rung has a first side with a first opening, and a second side with a second opening, and wherein the hollow ladder rung has a length between the first opening and the second opening, and wherein the support has a length that is longer than the length of the hollow ladder rung wherein the support includes a safety tab that is on the second side of the hollow ladder rung when the device is installed, to prevent removal of the device from the hollow ladder rung.

6. A device comprising:

a support, including a first section and a second section, for inserting into a hollow ladder rung, wherein the first section includes a part of the support that only tightly fits inside a generally square shaped hollow ladder rung; and the second section includes a part of the support that only tightly fits inside a generally D-shaped hollow ladder rung; and further comprising a tool holder coupled to the second section of the support, the tool holder comprising:

a first portion extending along a longitudinal axis of the support and coupled to the support, and a second portion extending from the first portion, the second portion having a shape with an opening;

wherein the tool holder is a metal rod and wherein the opening is between approximately three-eighths of an inch to approximately three inches.

7. A device comprising:

a support structure having a first section to only tightly be inserted into a first ladder rung with a first generally square shaped rung cross section shape wherein the first section has a first cross section shape with a first flat top that is substantially similar to the first generally square shaped rung cross section shape, the support structure having a second section to only tightly be inserted into a second ladder rung with a second generally D-shaped rung cross section shape including a second flat top, wherein the second generally D-shaped rung cross section shape is larger than the first generally square shaped rung cross section shape of the first ladder rung; wherein the first section is connected to the second section along a longitudinal axis of the support structure; and a tool holder attached to the second section of the support structure wherein the second section is tapered having a smaller circumference at a first end of the second section and a larger circumference than the smaller circumference at a second end of the second section.

8. The device according to claim 7 wherein the tool holder comprises:

a first portion extending along a longitudinal axis of the support structure and extending from the support structure, a second portion extending from the first portion, the second portion having a shape with an opening, the shape having a beginning and an end.

9. The device according to claim 8 wherein the opening is about three-eighths of an inch to approximately three inches.

10. The device according to claim 9 wherein the opening is about three-quarters of an inch.

11. The device according to claim 9 wherein the opening is about one inch.

12. A device comprising:

a support configured to securely fit into a hollow rung of a ladder having a first section with a first generally flat top, the first section having a generally square shape cross section, and a second section with a second generally flat top, the second section having a generally "D" shape cross section, wherein the support aligns rotation of the support to the flat top of the hollow rung of the ladder, and prevents rotation of the support when inserted into the hollow rung of the ladder;

a tool holder connected to the support, wherein the tool holder is fixed rotationally to the support, wherein the tool holder has a shape generally within a flat plane that is substantially parallel to the generally flat top of the hollow rung, wherein the shape has a width and length, and where in the shape has an end that forms an opening, wherein the opening has a distance defined by a narrowest point that would restrict an object larger than between approximately three-eighths of an inch to approximately three inches passing through the opening into the shape, and wherein the opening is narrower than the width of the shape, and wherein the opening is narrower than the length of the shape.

13. The device according to claim 12 wherein the tool holder is configured to allow a three-quarter-inch hose to pass through the opening.

* * * * *